US005188387A

United States Patent [19]

Ruffinengo

[11] Patent Number: 5,188,387

[45] Date of Patent: Feb. 23, 1993

[54] SKI BINDING INCORPORATING BOTH ELECTRONIC AND MECHANICAL RELEASE SYSTEMS

[76] Inventor: Piero G. Ruffinengo, 820 Edgehill Rd., Salt Lake City, Utah 84103

[21] Appl. No.: 591,814

[22] Filed: Oct. 2, 1990

[30] Foreign Application Priority Data

Oct. 2, 1989 [DE] Fed. Rep. of Germany ..... 3932892

[51] Int. Cl.[5] ..... A63C 9/088

[52] U.S. Cl. ..... 280/612; 280/613

[58] Field of Search ..... 280/611, 612, 613, 625, 280/DIG. 13

[56] References Cited

U.S. PATENT DOCUMENTS

| | | | |
|---|---|---|---|
| 4,159,124 | 6/1979 | Salomon | 280/612 |
| 4,436,321 | 3/1984 | Storandt et al. | 280/612 |
| 4,484,761 | 11/1984 | Knabel et al. | 280/612 |
| 4,589,673 | 5/1986 | Dimier et al. | 280/612 |

FOREIGN PATENT DOCUMENTS

| | | | |
|---|---|---|---|
| 421180 | 4/1991 | European Pat. Off. | 280/612 |

*Primary Examiner*—Eric D. Culbreth

*Attorney, Agent, or Firm*—D. Peter Hochberg; Mark Kusner; Louis J. Weisz

[57] ABSTRACT

A ski binding release mechanism that includes both an electronic and a mechanical release mechanism. The mechanical release mechanism incorporates a delay feature that allows it to function only if the electronic mechanism experiences a failure. The delay feature is provided by a cylinder movable with respect to a stationary piston positioned therein, the piston dividing the cylinder into two chambers. Movement of the cylinder, required to release the soleholder of a ski boot, is retarded by the time required to pass liquid in the cylinder from a first of the chambers to a second of the chambers through a choke passage in the piston as the cylinder moves. Movement of the cylinder is caused by a plunger connected to the soleholder of the ski binding that urges against the cylinder under the influence of a sustained, predetermined, potentially hazardous force acting on the binding. A spring may be located within the cylinder to absorb intermittent forces imposed on the cylinder not strong enough to pose a hazard. Resetting of the device may be accelerated through provision of a check valve in the piston that allows the fluid to move back into the second chamber through the valve, as well as through the choke passage.

14 Claims, 1 Drawing Sheet

SKI BINDING INCORPORATING BOTH ELECTRONIC AND MECHANICAL RELEASE SYSTEMS

TECHNICAL FIELD

This invention relates to safety ski binding release systems. More particularly, this invention relates to the provision of redundant mechanical release mechanisms that operate to release a skier's boot from a ski binding when the primary electronic release mechanism fails to operate. Specifically, this invention relates to compound safety ski bindings that include both mechanical and electronic release mechanisms, and in which the mechanical mechanism includes a delay feature that allows the electronic mechanism to assume release priority, but which becomes operative in the event that the electronic mechanism fails to operate.

BACKGROUND OF THE INVENTION

Safety ski bindings have long been a feature of quality ski equipment since they function to release a skier's boot when forces dangerous to the skier are applied thereto. Such forces are commonly experienced, for example, in the case of a fall where the leverage of an attached ski could cause the skier's lower limbs to experience potentially damaging forces. Release of the boot from the binding in such instances minimizes the forces experienced during the fall, thus helping to prevent injuries, including bone trauma to the skier's ankles and legs.

In the past, bindings have typically featured mechanical release mechanisms; however, considerable effort has been devoted to the development of release bindings that rely upon electronic circuitry since bindings incorporating such circuitry offer the possibility of more precise and consistent response to whatever threshold release force is selected to activate the binding release.

One form of such electronic binding comprises electronic circuitry that includes at least one transducer positioned to detect forces acting on the bindings in a particular direction. The transducers produce a release-triggering current when subjected to a threshold force value, resulting in operation of the mechanism and release of the skier's boot. The current, for example, is operative to energize or de-energize an electromagnet, depending upon the circuitry, the components of the mechanism then acting to produce the desired release.

While electronic bindings have much to commend them, they have the disadvantage of being susceptible to inoperativeness caused by the occasional failure of a component in the circuit, the electromagnet, or in the battery energizing it. Such failures are sometimes difficult to detect beforehand, and so can result in failure of the binding to release when necessary with the injurious consequences which that can entail.

In view of the potential advantages that electronic bindings offer, a number of efforts have been made to overcome the drawbacks described, and remedial designs have been utilized to compensate for such drawbacks.

German Patent No. 2,737,535 A-1, for instance, employs shear pins to support the sole holder portion of the binding. When the binding is subjected to unacceptable stresses, the shear pins fail, releasing the sole holder and freeing the boot from the ski binding. Unfortunately, the holder thus released must be re-attached to the ski, an operation not readily performed on a ski slope. Consequently, the necessity of reattachment can seriously interrupt skiing activity for the day on which the accident occurs, interfering with the pleasure of skiing.

Another approach to the problem is that envisioned by German Patent No. 2,938,756 A-1 which employs an electronic logic system that depends upon electronic monitoring of the release system'state of operativeness. The device incorporates switching means that shifts the release function from one activated by electronics to a mechanical release system when a fault develops. The drawback of such an approach, however, is that additional circuitry is required, an expedient that is both expensive and also vulnerable to malfunctioning.

German Patent No. 3,017,841 C-2 provides dual release functionality including both mechanical and electronic release mechanisms. In this device also, however, it is necessary that an error be detected and a signal generated for subsequent transmission to an operating mode switch capable of changing the release system from an electronic to a mechanical release mode.

BRIEF DESCRIPTION OF THE INVENTION

In view of the foregoing, therefore, it is a first aspect of this invention to provide a ski binding with dual binding release functionality.

A second aspect of this invention is to provide a ski binding having dual binding release functionality that requires no detection means to discern failure of the primary release system, nor the generation of a switching command to change to the secondary, back-up release system.

Another aspect of this invention is to provide a ski binding having an electronic binding release function, and a mechanical binding release function in which the mechanical function is continuously operable, activating automatically in the event of failure of the electronic system.

A further aspect of this invention is to provide a ski binding having an electronic binding release function, and a mechanical binding release function in which the functioning of the latter is delayed until the former has had an opportunity to operate.

An additional aspect of this invention is to provide a ski binding having an electronic binding release mechanism, and a mechanical binding release mechanism in which the latter mechanism has force-dampening means associated therewith so that the mechanism will not activate in the absence of a substantially sustained force of a release threshold magnitude acting thereon.

Still another aspect of this invention is to provide an electronic ski binding release system with a redundant mechanical binding release mechanism that provides continuing release capability despite the incapacity of the electronic release system.

Yet a further aspect of this invention is to provide a ski binding with dual binding release functionality that includes a mechanical binding release mechanism that has rapid reset capability.

The preceding and other aspects of the invention are provided by a ski binding release mechanism for a ski having dual release functionality comprising: electronic binding release means, and mechanical binding release means, said electronic means and said mechanical means both being adapted to unlatch the bootsole latch of a ski binding incorporating said mechanism when the binding is subjected to a predetermined threshold force in a selected direction, wherein said mechanical release means includes a mechanical delay means providing sufficient time for said electronic release means to function before said mechanical release means can function, so that if said electronic release means fails to function, said mechanical release means functions.

The preceding and further aspects of the invention are provided by a ski having a ski binding release mechanism according to the preceding paragraph.

The preceding and additional aspects of the invention are provided by a ski binding release mechanism for a ski having dual release functionality including both electronic and mechanical binding release means, wherein said electronic binding release means comprises: transducer means; an electromagnet; and a pivotal armature, said pivotal armature being associated with, and adjacent to said electromagnet and urged by spring means to pivot from said electromagnet in the absence of an operative magnetic force emanating therefrom thereby unlatching bootsole latching means, said electromagnet permitting and preventing pivoting of said pivotal armature depending upon whether said electromagnet receives an electrical impulse generated when said transducer means is subjected to a predetermined threshold force acting in a selected direction on a ski binding provided with said mechanism, and wherein said mechanical binding release means includes a delay feature that permits said electronic binding release means to operate before said mechanical binding release means becomes operational, said mechanical release means comprising: a movable, elongate cylinder; a cylinder piston; cylinder fluid; a plunger; spring means; and bootsole latch engaging means, said bootsole latch engaging means being connected to said cylinder, and said piston being located within said cylinder and fixable in position relative to a ski associated with said mechanism by a hollow rod extending at right angles from the center of said piston through a first end of said cylinder, one end of said plunger being connectable to the ski bootsole holder of a ski binding, and the other end extending through both ends of said cylinder and through said piston and said hollow rod, said plunger including first and second flanges as a part thereof, said first flange being located at the unconnectable end of said plunger, outside and adjacent said second end of said cylinder, and said second flange being located between said second end and said piston, while said spring means is located between said second end and said second flange, wherein the space between the said piston and said first end of said cylinder defines a first chamber, and the space between said piston and said second end of said cylinder defines a second chamber, both chambers being adapted to hold said fluid therein, and said piston being provided with a choke passage therethrough, whereby when said ski binding is subjected to said threshold force and said electronic binding release means fails to operate, said plunger is urged toward said second end, said force being initially restrained by the resistance of said spring means against said second flange, and the movement of said cylinder toward its second end caused by the force of said spring against said second end being delayed by the time required to displace said liquid from said first chamber to said second chamber through said choke passage, whereby further, when said threshold force becomes inoperative, said first flange is caused to urge against said second end, moving said cylinder back towards its first end, said movement transferring liquid from said second chamber to said first chamber through said passageway, resulting in resetting of the mechanism.

The preceding and still other aspects of the invention are provided by a ski having a ski binding release mechanism according to the preceding paragraph.

A preceding and still other aspects of the invention are provided by a mechanical ski binding release mechanism for a ski binding comprising: a movable, elongate cylinder; a cylinder piston; cylinder fluid; a plunger; spring means; and bootsole latch engaging means, said bootsole latch engaging means being connected to said cylinder and said piston being located within said cylinder and fixable in position relative to a ski associated with said mechanism by a hollow rod extending at right angles from the center of said piston through a first end of said cylinder, one end of said plunger being connectable to the ski bootsole holder of a ski binding, and the other end extending through both ends of said cylinder and through said piston and said hollow rod, said plunger including first and second flanges, said first flange being located at the unconnected end of said plunger, outside and adjacent said second end of said cylinder, and said second flange being located between said second end and said piston, while said spring means is located between said second end and said second flange, wherein the space between said piston and said first end of said cylinder defines a first chamber, and the space between said piston and said second end of said cylinder defines a second chamber, both chambers being adapted to hold said fluid therein, said piston being provided with a choke passage therethrough and a check valve therein, said check valve only allowing said fluid to pass from said second chamber to said first chamber, whereby when said ski binding is subjected to a threshold force, said plunger is urged toward said second end, said force being initially restrained by the resistance of said spring means against said second flange, and the movement of said cylinder toward its second end caused by the force of said spring means against said second end being delayed by the time required to displace said liquid from said first chamber to said second chamber through said choke passage, whereby further, when said force becomes inoperative, said first flange is caused to urge against said second end, moving said cylinder back toward its first end, said movement transferring liquid from said second chamber to said first chamber through said check valve, as well as through said passage way, resulting in rapid resetting of the mechanism.

The preceding and yet further aspects of the invention are provided by a ski having a ski binding release mechanism according to the preceding paragraph.

BRIEF DESCRIPTION OF THE DRAWINGS

The invention will be better understood when reference is had to the following FIGURE showing a semi-schematic view of the electronic ski boot release mechanism, a partial semi-schematic view of a ski bootsole holder, and a semi-schematic partial view of a mechanical ski boot release mechanism.

DETAILED DESCRIPTION OF THE INVENTION

Figure 1:
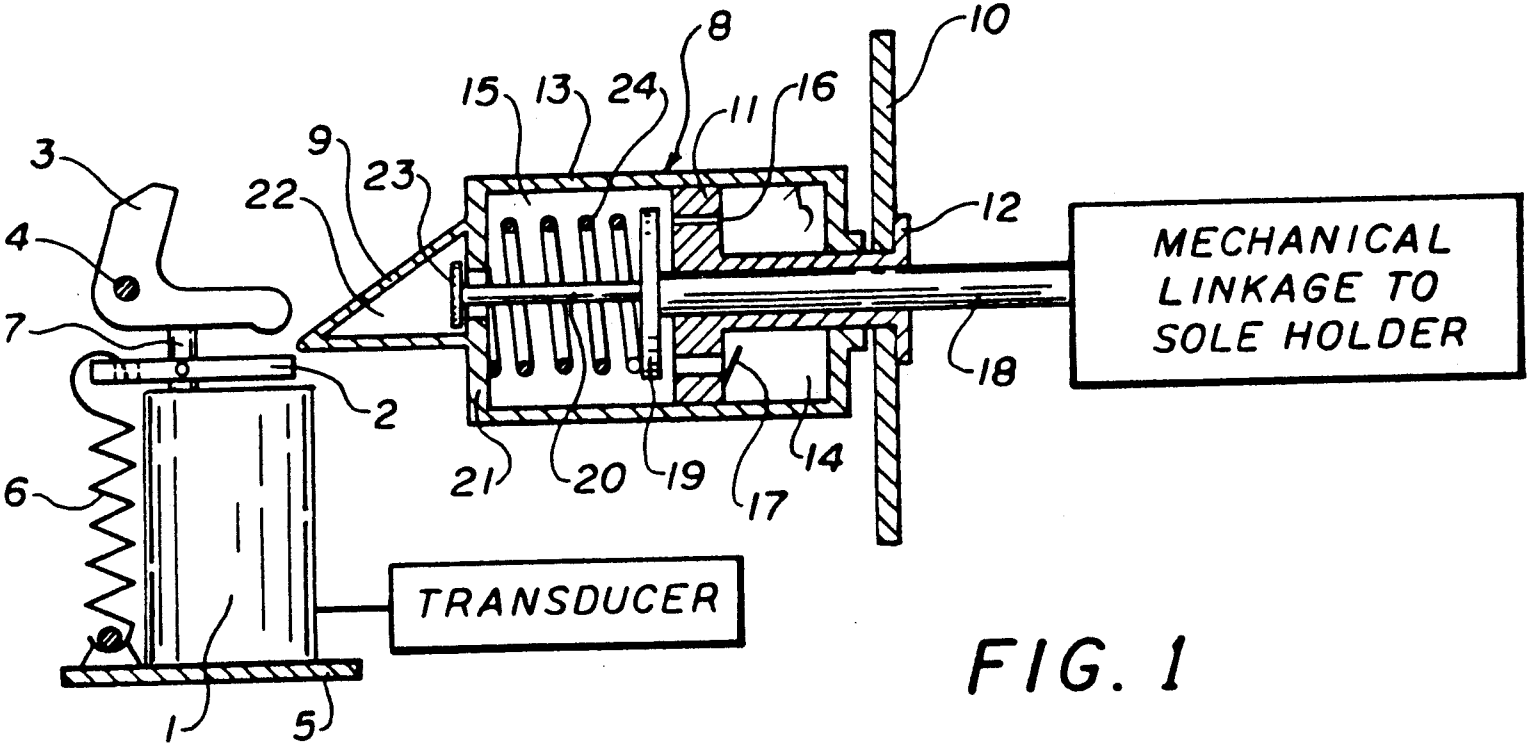

The FIGURE shows a semi-schematic, partial view of a compound ski boot release mechanism that includes an electronic release component, a mechanical release component, and a ski bootsole holder. As shown, the electronic portion of the release mechanism comprises an electromagnet 1 connected to a base plate 5, and having an armature 2 pivotally positioned adjacent the top of the electromagnet. In the absence of armatureimmobilizing magnetic attraction from electromagnet 1, the armature 2 is urged by a pivot spring 6 connecting the armature to the base plate 5 to pivot in a counterclockwise direction. In so pivoting, armature 2, guided by abutment 7 extending from the top of the magnet, engages an end of bell crank 3 thus causing the crank to pivot about pivot pin 4, movement of the bell crank, or structure associated therewith, resulting in the release of the sole of a ski boot. The bell crank is urged in a clockwise direction by a spring, not shown, being held in the position illustrated, in the FIGURE, i.e., resting on abutment 7, until the force of said spring is overcome by the force of the armature acting upon it, as described.

Also forming part of the electronic portion of the release mechanism, but not illustrated, is appropriate circuitry of the type well known in the art, including a battery and one or more transducers.

Additionally shown in the FIGURE, is the mechanical portion of the binding release, generally 8, comprising an engaging member 9, provided with a cavity 22 therein, the engaging member being connected to a cylinder 13. Cylinder 13 is divided into a first cylinder chamber 14, and a second cylinder chamber 15 by a piston 11. Cylinder 13 is movable relative to piston 11, the latter being immovable relative to a base plate 10 by virtue of the attachment of a hollow piston rod 12 that connects the piston 11 to the base plate. As in the case of base plate 5, base plate 10 is also attachable directly or indirectly to a ski binding connectable to a ski.

As shown, piston 11 includes a choke passage 16 and a check valve 17. A plunger 18 includes a larger diameter portion attachable to the sole holder of a ski binding, to the right in the FIGURE, and a smaller diameter extension 20, to the left in the FIGURE, about which is disposed a dampening spring 24. As can be seen, plunger 18 extends through the hollow center of piston 11 and piston rod 12, and through both ends of cylinder 13, and is provided with a plunger extension flange 23 and a spring abutment flange 19.

In performing its release function, the mechanism works in the following manner. In the absence of a potentially damaging force acting on the ski binding, the electromagnet 1, which preferably is of the remanent or permanent magnet type, retains the armature 2 in close association with the top thereof due to the magnetic force emanating from the magnet. When such a force is experienced, however, at least one transducer positioned in a location suited to detect the force produces an electronic signal that directly or indirectly, depending upon the circuitry involved, acts to disable the magnetic force holding the armature adjacent to the electromagnet. With the magnetic force thus inoperative, pivot spring 6 causes the armature to pivot upwards, engaging the end of the bell crank 3, in turn forcing the latter to pivot in a counterclockwise direction in the FIGURE against a spring which would otherwise hold it in place on abutment 7. Pivoting of the bell crank 3 either directly or indirectly produces the unlatching of a soleholder, not shown, holding the ski boot in the binding.

In the event of a malfunction, as for example in the event of a circuit failure, loss of power from the battery, or because of some other reason the electronic release mechanism should fail to function, release of the binding is procured through the action of the mechanical release system as follows.

The same force that would otherwise produce release of the ski boot by the electronic release mechanism also acts upon the mechanical release system 8 by virtue of the attachment, either directly or indirectly, of plunger 18 to the soleholder of the ski binding. Such force is transmitted by the plunger and its attached spring abutment flange 19 to dampening spring 24. Temporary forces experienced of the type insufficient to cause damage to the skier's limbs are transmitted by the spring abutment flange to the dampening spring, the plunger extension flange 23 being free to move within the bootsole latch engaging member cavity 22 in response to intermittent, short-term compression of the spring. Although the spring 24 bears against the cylinder end wall 21 as the mechanism is subjected to such intermittent forces, cylinder 13 is restrained from precipitant movement that might otherwise prematurely result in release of the ski boot by a delay mechanism described in the following.

As can be seen from the FIGURE, cylinder 13 is divided by piston 11 into a first cylinder chamber 14, and a second cylinder chamber 15, both of which are adapted to contain a cylinder fluid, not shown. Consequently, before cylinder 13 can move relative to the piston 11, to the left in the FIGURE, the fluid in the first cylinder chamber must be transferred to the second cylinder chamber. Such transfer is accomplished through a choke passage 16 that retards passage of the fluid due to its limited cross-sectional area, which may be varied, long enough to allow the electronic release to operate, but not so long as to allow the force to result in injury to the skier. When the mechanism is subjected to intermittent forces of relatively short duration, such delay is sufficient to prevent movement of the cylinder far enough so that the bootsole latch engaging member 9 engages the end of bell crank 3 or some other structural feature, for example armature 2, to trigger a release. When, however, such force is substantially sustained, sufficient of the cylinder liquid is transferred to accommodate movement of the cylinder to a bell crank-engaging release position.

The delay thus provided is long enough so that the electronic release mechanism has a prior opportunity to release the soleholder before the mechanical system becomes operative, assuring operation of the mechanical system only as a back-up release for the ski boot held in the binding.

While the mechanical release system could function without the presence of a dampening spring 24, its use is preferred since it helps to absorb minor and intermittent forces as previously described.

Piston 11 may also include a check valve passageway 17 that is designed to block the transfer of fluid from the first cylinder chamber to the second cylinder chamber, but to allow flow in the opposite direction. Although not required, its use is preferred since after the force on the binding has become inoperative, plunger 18 re-establishes its original position, moving to the right in the FIGURE either as a result of urging from a special spring provided for the purpose, not shown, or as a consequence of the return motion of the binding, and urging cylinder 13 to move in the same direction as a result of the contact of plunger extension flange 23 against the cylinder end wall 21, re-establishing the cylinder's initial, normal position. When the cylinder 13 moves to the right, cylinder fluid is transferred through check valve 17, as well as choke passage 16 allowing a more rapid resetting of the mechanism to its original state prior to action of the force then would otherwise be possible in the absence of the check valve.

The advantage of the compound release systems is that the mechanical system is independent of the electronic system and is always ready to operate under the influence of a potentially dangerous force acting on the binding. The mechanical system does not require "cocking", or a switch-over operation. Thus, while the consistency and accuracy of an electronic release system is retained in the absence of malfunctioning, in the event of disability of the electronic system, the mechanical system is fully and reliably operable.

While in accordance with the patent statutes, a preferred embodiment and best mode has been presented, the scope of the invention is not limited thereto, but rather is measured by the scope of the attached claims.

We claim:

1. A ski binding release mechanism for a ski having dual release functionality comprising:

electronic binding release means, and mechanical binding release means, said electronic means and said mechanical means both being simultaneously activated and act upon and thereby adapted to unlatch a bootsole latch of a ski binding incorporating said mechanism when the binding is subjected to a predetermined threshold force in a selected direction, wherein, however, said mechanical release means includes a mechanical delay means providing sufficient time for said electronic release means to function before said mechanical release means can function, so that if said electronic release means fails to function, said mechanical release means functions.

2. A ski binding release mechanism according to claim 1 mounted on a ski.

3. A ski binding release mechanism according to claim 1 wherein said electronic binding release means comprises:

transducer means;

magnetic means; and first latch-release activating means, said first latch-release activating means being movable to unlatch said bootsole latch in consequence of an electrical impulse received by said magnetic means when said transducer means of said binding is subjected to said threshold force, and wherein said mechanical binding release means comprises second latch-release activating means, said second latch-release activating means being movable in response to said threshold force to unlatch said bootsole latch, the action of said second latch release activating means being delayed to provide time for said electronic binding release means to operate before said mechanical binding release means.

4. A ski binding release mechanism according to claim 3 wherein said magnetic means comprises an elecromagnet, and said first latch-release activating means comprises a pivotal armature adjacent to said electromagnet urged by pivot means to pivot from said electromagnet, and in so pivoting, to unlatch bootsole latching means, wherein said electromagnet permits and prevents such pivoting by said pivot means depending upon whether said electromagnet receives an electrical impulse as a result of the application of said threshold force on said transducer means.

5. A ski binding release mechanism according to claim 4 wherein said pivot means comprises a spring that urges said pivotal armature to pivot from said electromagnet.

6. A ski binding release mechanism for a ski having dual release functionality comprising:

electronic binding release means, and mechanical binding release means, said electronic means and said mechanical means both being adapted to unlatch a bootsole latch of a ski binding incorporating said mechanism when the binding is subjected to a predetermined threshold force in a selected direction, said electronic binding release means comprising:

transducer means;

magnetic means; and first latch-release activating means, said first latch-release activating means being movable to unlatch said bootsole latch in consequence of an electrical impulse received by said magnetic means when said transducer means of said binding is subjected to said threshold force, and said mechanical binding release means comprising second latch-release activating means, said second latch-release activating means being movable in response to said threshold force to unlatch said bootsole latch, the release caused by said second latch release activating means being delayed to provide time for said electronic binding release means to cause a release before said mechanical binding release means, wherein said magnetic means comprises an electromagnet, and said first latch-release activating means comprises a pivotal armature adjacent to said electromagnet urged by pivot means to pivot from said electromagnet, and in so pivoting, to unlatch bootsole latching means, said electromagnet permitting and preventing such pivoting by said pivot means depending upon whether said electromagnet receives an electrical impulse as a result of the application of said threshold force on said transducer means, and wherein said second latch-release activating means comprises:

a movable elongate cylinder;

bootsole latch engaging means; and a plunger with two ends, said bootsole latch engaging means being connected to said cylinder with one end of said plunger being positioned in said cylinder, while its other end is adapted for connection to the ski boot soleholder of a ski binding, said threshold force being operative to urge said plunger against said cylinder, causing said latch engaging means to engage and unlatch said bootsole latch.

7. A ski binding release mechanism for a ski having dual release functionality comprising:

electronic binding release means, and mechanical binding release means, said electronic means and said mechanical means both being adapted to unlatch a bootsole latch of a ski binding incorporating said mechanism when the binding is subjected to a predetermined threshold force in a selected direction, said electronic binding release means comprising:

transducer means;

magnetic means; and first latch-release activating means, said first latch-release activating means being movable to unlatch said bootsole latch in consequence of an electrical impulse received by said magnetic means when said transducer means of said binding is subjected to said threshold force, and said mechanical binding release means comprising second latch-release activating means, said second latch-release activating means being movable in response to said threshold force to unlatch said bootsole latch, the release caused by said second latch release activating means being delayed to provide time for said electronic binding release means to cause a release before said mechanical binding release means;

wherein said magnetic means comprises an electromagnet, and said first latch-release activating means comprises a pivotal armature adjacent to said electromagnet urged by pivot means to pivot from said electromagnet, and in so pivoting, to unlatch bootsole latching means, said electromagnet permitting and preventing such pivoting by said pivot means depending upon whether said electromagnet receives an electrical impulse as a result of the application of said threshold force on said transducer means;

wherein said second latch-release delay is provided by a mechanism comprising:

spring means;

a cylinder piston; and cylinder fluid, said piston being located within a cylinder and being fixable in position relative to a ski associated with said mechanism by a hollow rod extending from the center of said piston through a first end of said cylinder, a plunger extending through both ends of said cylinder and through said piston and said hollow rod, said plunger including first and second flanges, the first said flange being located at a free end of said plunger, outside and adjacent to a second end of said cylinder, and said second flange being located between said second end and said piston, while said spring means is located between said second end and said second flange;

wherein the space between said piston and said first end of said cylinder defines a first chamber, and the space between said piston and said second end of said cylinder defines a second chamber, both chambers being adapted to hold said fluid therein, said piston being provided with a choke passage therethrough and a check valve therein, said check valve only allowing said fluid to pass from said second chamber to said first chamber;

wherein when said ski binding associated with said mechanism is subjected to said threshold force said plunger is urged toward said second end, said force being initially restrained by the resistance of said spring means against said second flange, and movement of said cylinder towards its second end caused by the force of said spring means against said second end being delayed by the time required to displace said liquid from said first chamber to said second chamber through said choke passage, and wherein further, when said threshold force becomes inoperative, said first flange is caused to urge against said second end, and said cylinder is moved back towards its first end, said movement displacing liquid from said second chamber to said first chamber through said check valve, as well as through said choke passage, resulting in rapid resetting of the mechanism.

8. A ski binding release mechanism for a ski having dual release functionality including both electronic and mechanical binding release means, wherein said electronic binding release means comprises:

transducer means;

an electromagnet; and a pivotal armature, said pivotal armature being associated with, and adjacent to said electromagnet and urged by spring means to pivot from said electromagnet in the absence of an operative magnetic force emanating therefrom thereby unlatching bootsole latching means, said electromagnet permitting and preventing pivoting of said pivotal armature depending upon whether said electromagnet receives an electrical impulse, generated when said transducer means is subjected to a predetermined threshold force acting in a selected direction on a ski binding provided with said mechanism, and wherein said mechnical binding release means includes a delay feature that permits said electronic binding release means to operate before said mechanical binding release means becomes operational, said mechanical release means comprising:

a movable, elongate cylinder;

a cylinder piston;

cylinder fluid;

a plunger;

spring means; and bootsole latch engaging means, said bootsole latch engaging means being connected to said cylinder, and said piston being located within said cylinder and fixable in position relative to a ski associated with said mechanism by a hollow rod extending at right angles from the center of said piston through a first end of said cylinder, one end of said plunger being connectable to the ski boot sole holder of a ski binding, and the other end extending through both ends of said cylinder and through said piston and said hollow rod, said plunger including first and second flanges as a part thereof, said first flange being located at a free end of said plunger, outside and adjacent said second end of said cylinder, and said second flange being located between said second end and said piston, while said spring means is located between said second end and said second flange, wherein the space between said piston and said first end of said cylinder defines a first chamber, and the space between said piston and said second end of said cylinder defines a second chamber, both chambers being adapted to hold said fluid therein, and said piston being provided with a choke passage therethrough, whereby when said ski binding is subjected to said threshold force and said electronic binding release means fails to operate, said plunger is urged toward said second end, said force being initially restrained by the resistance of said spring means against said second flange, and the movement of said cylinder toward its second end caused by the force of said spring means against said second end being delayed by the time required to displace said liquid from said first chamber to said second chamber through said choke passage, whereby further, when said threshold force becomes inoperative, said first flange is caused to urge against said second end, moving said cylinder back toward its first end, such movement transferring liquid from said second chamber to said first chamber through said passageway, resulting in resetting of the mechanism.

9. A ski binding release mechanism according to claim 8 mounted on a ski.

10. A mechanical ski binding release mechanism for a ski binding comprising:

a movable, elongate cylinder;
a cylinder piston;
cylinder fluid;
a plunger;
spring means; and
bootsole latch engaging means, said bootsole latch engaging means being connected to said cylinder, and said piston being located within said cylinder and fixable in position relative to a ski associated with said mechanism by a hollow rod extending at right angles from the center of said piston through a first end of said cylinder, one end of said plunger being connectable to the ski boot sole holder of a ski binding, and the other end extending through both ends of said cylinder and through said piston and said hollow rod, said plunger including first and second flanges, said first flange being located at a free end of said plunger, outside and adjacent said second end of said cylinder, and said second flange being located between said second end and said piston, while said spring means is located between said second end and said second flange, wherein the space between said piston and said first end of said cylinder defines a first chamber, and the space between said piston and said second end of said cylinder defines a second chamber, both chambers being adapted to hold said fluid therein, said piston being provided with a choke passage therethrough and a check valve therein, said check valve only allowing said fluid to pass from said second chamber to said first chamber, whereby when said ski binding is subjected to said threshold force, said plunger is urged toward said second end, said force being initially restrained by the resistance of said spring means against said second flange, and the movement of said cylinder toward its second end caused by the force of said spring means against said second end being delayed by the time required to displace said liquid from said first chamber to said second chamber through said choke passage, whereby further, when said force becomes inoperative, said first flange is caused to urge against said second end, moving said cylinder back toward its first end, said movement transferring liquid from said second chamber to said first chamber through said check valve, as well as through said passageway, resulting in rapid resetting of the mechanism.

11. A mechanical ski binding release mechanism according to claim 10 wherein said bootsole latch engaging means is a wedge shaped member.

12. A binding release mechanism according to claim 10 mounted on a ski.

13. A ski binding release mechanism for a ski having dual release functionality comprising:

electronic binding release means, and
mechanical binding release means, said electronic means and said mechanical means both being adapted to act upon and thereby unlatch a bootsole latch of a ski binding incorporating said mechanism when the ski binding is subjected to a predetermined threshold in a selected direction, wherein said mechanical release means includes a mechanical delay means providing sufficient time for said electronic release means to function before said mechanical release means can function, so that if said electronic release means fails to function, said mechanical release means functions, wherein said electronic release means comprises:
transducer means;
magnetic means; and
first latch-release activating means, said first latch-release activating means being movable to unlatch said bootsole latch in consequence of an electrical impulse received by said magnetic means when said transducer means of said binding is subjected to said threshold force, said mechanical binding release means comprising second latch-release activating means, and said second latch-release activating means being movable in response to said threshold force to unlatch said bootsole latch, the action of said second latch release means being delayed to provide time for said electronic binding release means to operate before said mechanical release means, wherein further said magnetic means comprises an electromagnet, and said first latch-release activating means comprises a pivotal armature adjacent to said electromagnet urged by pivot means to pivot from said electromagnet, and in so pivoting, to unlatch bootsole latching means, said electromagnet permiting and preventing such pivoting by said pivot means depending upon whether said electromagnet receives an electrical impulse as a result of the application of said threshold force on said transducer means, wherein still further said pivot means comprises a spring that urges said pivotal armature to pivot from said electromagnet, and wherein said second latch-release activating means comprises:
a movable elongate cylinder;
bootsole latch engaging means; and
a plunger, said bootsole latch engaging means being connected to said cylinder with one end of said plunger being positioned in said cylinder, while a second end is adapted for connection to a ski binding, said threshold force being operative to urge said plunger against said cylinder, causing said latch engaging means to engage and pivot said bootsole latch into an unlatched position.

14. A ski binding release mechanism for a ski having dual release functionality comprising:

electronic binding release means, and
mechanical binding release means, said electronic means and said mechanical means both being adapted to act upon and thereby unlatch a bootsole latch of a ski binding incorporating said mechanism when the ski binding is subjected to a predetermined threshold in a selected direction, wherein said mechanical release means includes a mechanical delay means providing sufficient time for said electronic release means to function before said mechanical release means can function, so that if said electronic release means fails to function, said mechanical release means functions, wherein said electronic release means comprises:
transducer means;
magnetic means; and first latch-release activating means, said first latch-release activating means being movable to unlatch said bootsole latch in consequence of an electrical impulse received by said magnetic means when said transducer means of said binding is subjected to said threshold force, said mechanical binding release means comprising second latch-release activating means, and said second latch-release activating means being movable in response to said threshold force to unlatch said bootsole latch, the action of said second latch release means being delayed to provide time for said electronic binding release means to operate before said mechanical release means, wherein further said magnetic means comprises an electromagnet, and said first latch-release activating means comprises a pivotal armature adjacent to said electromagnet urged by pivot means to pivot from said electromagnet, and in so pivoting, to unlatch bootsole latching means, said electromagnet permiting and preventing such pivoting by said pivot means depending upon whether said electromagnet receives an electrical impulse as a result of the application of said threshold force on said transducer means, wherein still further said latch-release delay comprises:

spring means;

a cylinder piston; and cylinder fluid, said piston being located within said cylinder and being fixable in position relative to a ski associated with said mechanism by a hollow rod extending at right angles from the center of said piston through a first end of said cylinder; a plunger extending through both ends of said cylinder and through said piston and said hollow rod, said plunger including first and second flanges, the first said flange being located at a free end of said plunger, outside and adjacent to a second end of said cylinder, and said second flange being located between said second end and said piston, while said spring means is located between said second end and said second flange, wherein the space between said piston and said first end of said cylinder defines a first chamber, and the space between said piston and said second end of said cylinder defines a second chamber, both chambers being adapted to hold said fluid therein, said piston being provided with a choke passage therethrough and a check valve therein, said check valve only allowing said fluid to pass from said second chamber to said first chamber, whereby when said ski binding associated with said mechanism is subjected to said threshold force said plunger is urged toward said second end, said force being initially restrained by the resistance of said spring means against said second flange, and movement of said cylinder towards its second end caused by the force of said spring means against said second end being delayed by the time required to displace said liquid from said first chamber to said second chamber through said choke passage, whereby further, when said threshold force becomes inoperative, said first flange is caused to urge against said second end, and said cylinder is moved back towards its first end, such movement displacing liquid from said second chamber to said first chamber through said check valve, as well as through said choke passage, resulting in rapid resetting of the mechanism.

* * * * *